United States Patent [19]

Bachmann

[11] 4,167,164

[45] Sep. 11, 1979

[54] CRANKCASE VENTILATION VALVE FOR INTERNAL COMBUSTION ENGINES

[76] Inventor: Max Bachmann, Austrasse 7, CH-8951 Fahrweid-Zurich, Switzerland

[21] Appl. No.: 872,057

[22] Filed: Jan. 25, 1978

[30] Foreign Application Priority Data

Jan. 31, 1977 [CH] Switzerland ..... 1152/77

[51] Int. Cl.[2] ..... F02M 25/06

[52] U.S. Cl. ..... 123/119 B

[58] Field of Search ..... 123/119 B

[56] References Cited

U.S. PATENT DOCUMENTS

| | | | |
|---|---|---|---|
| 2,775,960 | 1/1957 | Druzynski | 123/119 B |
| 3,056,420 | 10/1962 | Dietrich | 123/119 B |
| 3,138,148 | 6/1964 | Cauvin | 123/119 B |
| 3,144,044 | 8/1964 | Anthes | 123/119 B |
| 3,225,753 | 12/1965 | Bintz | 123/119 B |
| 3,455,285 | 7/1969 | Sheppard | 123/119 B |
| 3,839,996 | 10/1974 | DeBiasse | 123/119 B |

FOREIGN PATENT DOCUMENTS

| | | | |
|---|---|---|---|
| 1526575 | 4/1970 | Fed. Rep. of Germany | 123/119 B |

*Primary Examiner*—Wendell E. Burns
*Attorney, Agent, or Firm*—Shapiro and Shapiro

[57] ABSTRACT

Crankcase ventilation valve for internal combustion engines with a valve casing which is divided into a first and a second chamber by a displaceable wall sealingly attached at the periphery, wherein the first chamber is in communication with the atmosphere and the second chamber is in communication on the one hand through an inlet tube with the crankcase and on the other hand through an outlet tube with the suction device by way of a cylindrical tubular member disposed in the second chamber, the displaceable wall and the tubular member being constructed as a non-return valve and the valve seat being surrounded by a concentric ring space which is connected to the inlet tube.

11 Claims, 2 Drawing Figures

CRANKCASE VENTILATION VALVE FOR INTERNAL COMBUSTION ENGINES

Figure 1:
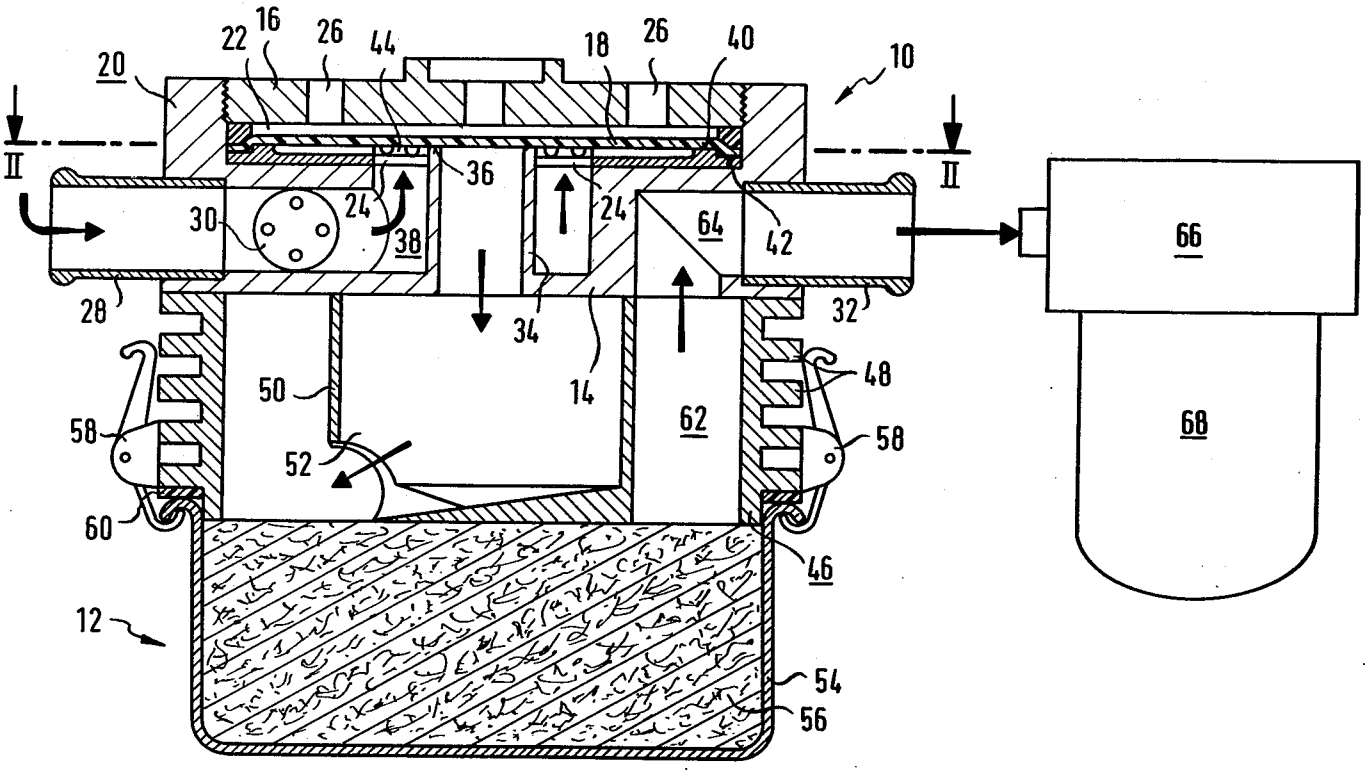

The invention relates to a crankcase ventilation valve for internal combustion engines with a valve casing which is divided into a first and a second chamber by a displaceable wall which is sealingly attached at the periphery, wherein the first chamber is in communication with the atmosphere and the second chamber is in communication on the one hand through an inlet tube with the crankcase and on the other hand through an outlet tube with the suction device by way of a cylindrical tubular member disposed in the second chamber, the displaceable wall and the tubular member being constructed as a non-return valve and the valve seat being surrounded by a concentric ring space which is connected to the inlet tube.

It is known that the reciprocating and revolving masses of an internal combustion engine, such as e.g. pistons, valves, piston rods, cam shafts, crank shafts and so on, produce in their respective casings a more or less high overpressure which depends upon the operating temperature.

In practically all engines a compensation into the free atmosphere must then be provided in order to prevent such a pressure rise. Since the gases flowing into the open are environmentally dangerous to a high degree, it is prescribed in most countries that these gases are returned to the carburettor for after-combustion.

Owing to the different pressure conditions which depend on the rotary speed, in the crankcase and in the carburettor a return of the gases which is perfect for the operation of the internal combustion engine is established only by means of a ventilation valve disposed between the crankcase and the carburettor, and by which valve the direct influence of the suction pressure on the gas stream supplied to the carburettor is reduced and thereby the desired pressure in the crankcase may be maintained.

In a known crankcase ventilation valve (German Offenlegungsschrift No. 1 526 575) a partial region of the displaceable wall is rigidly connected to a cover limiting the first chamber and a cavity operating as compensation chamber is constructed as an attachment of the displaceable wall, the attachment projecting into the second chamber and being constructed in a tube-shaped manner and being in communication with the second connecting tube which is constructed at the upper end as a valve seat. For supporting the manner of operation of the ventilation valve a bi-metal spring is provided in this case in the first chamber and a coil spring in the second chamber.

In another crankcase ventilation valve U.S. Pat. No. 3,262,436) a third chamber divided off by means of a second displaceable wall is arranged above the first chamber which is in communication with the atmosphere, the third chamber being in connection with the suction device. A coil spring is arranged in the third chamber and presses against the second displaceable wall and thus limits the movement of the valve which is disposed in the second chamber which is in connection with the crankcase, as long as there prevails no underpressure necessary for overcoming the spring force. In this case, too, the manner of operation of the valve is supported by a coil spring.

In a further crankcase ventilation valve (U.S. Pat. No. 3,056,420) a coil spring disposed in the first chamber acts directly on a displaceable wall which divides the valve casing into a first and a second chamber, wherein the first chamber is in communication with the atmosphere and the second chamber is in communication on the one hand through a first connecting tube with the crankcase and on the other hand through a second connecting tube with the suction device. In this case the displaceable wall co-operates with the first connecting tube as a spring-loaded non-return valve. An adjuster screw is provided for regulating the spring force.

All known crankcase ventilation valves operate in a relatively sluggish manner and have a complicated construction.

The invention is based on the problem to reduce the direct influence of the suction pressure on the gas stream from the crankcase, in order to maintain the desired crankcase pressure and to dimension reliably the outflow of crankcase vapours to the suction device of the internal combustion engine, wherein the ventilation valve is to respond rapidly and is to have a simple construction.

This problem is solved according to the invention in that the displaceable wall is constructed as a diaphragm of light elastic material, that a support surface for the diaphragm is arranged around the tubular member forming the valve seat surface, above the concentric ring space, the diaphragm extending to the edge of the valve casing, that the support surface comprises an annular groove at the outer edge and radially extending support ribs which are arranged at a spacing and extend from the concentric ring space, wherein the diaphragm is arranged in the annular groove for providing a tension and rests on the support ribs in its closing position, and the surface ratio between the surface of the diaphragm loaded by the pressure of the suction device and that loaded by the pressure of the crankcase amounts to at least 1:10, preferably however from 1:25 to 1:30.

Thereby a valve is produced in an advantageous manner in which the mass inertia of the reciprocatorily oscillating diaphragm is very small, whereby a rapid response of the valve is obtained without the need for additional auxiliary means. The simple construction attained thereby ensures a trouble-free manner of operation of the valve. By means of the proportional association according to the invention, of the diaphragm surface with the pressure of the crankcase and the pressure of the suction device, respectively, the direct influence of the suction pressure on the ventilation gas stream is reduced considerably in an advantageous manner, so that an underpressure may be established in the crankcase even at low rotary speeds. A reduction of elasticity of the diaphragm by excessive extension owing to an underpressure present for an extended period of time in the crankcase is prevented in an advantageous manner by the support surface provided with support ribs. An annular groove at the outer edge of the support surface permits in an advantageous manner tension to be exerted on the diaphragm by means of a clamping ring.

In a further development of the invention it is provided that a pressure limiting valve is disposed in the inlet tube. Thereby a rise of the underpressure above a permissible value as well as also an objectionable overpressure in the crankcase owing to misfiring is avoided in an advantageous manner.

An idea further developing the invention resides in that the support surface is constructed as a filter-like support element. Thereby the manufacture of the support surface may be simplified in an advantageous manner.

In a particular constructional form of the invention a separator is disposed in the second chamber downstream of the non-return valve. The separator is provided with a filling of an absorbent material for retaining harmful substances separated out. Thereby soiling of the suction device is avoided in an advantageous manner.

A constructional example of the invention is illustrated in the drawing and is described below in detail.

Figure 2:
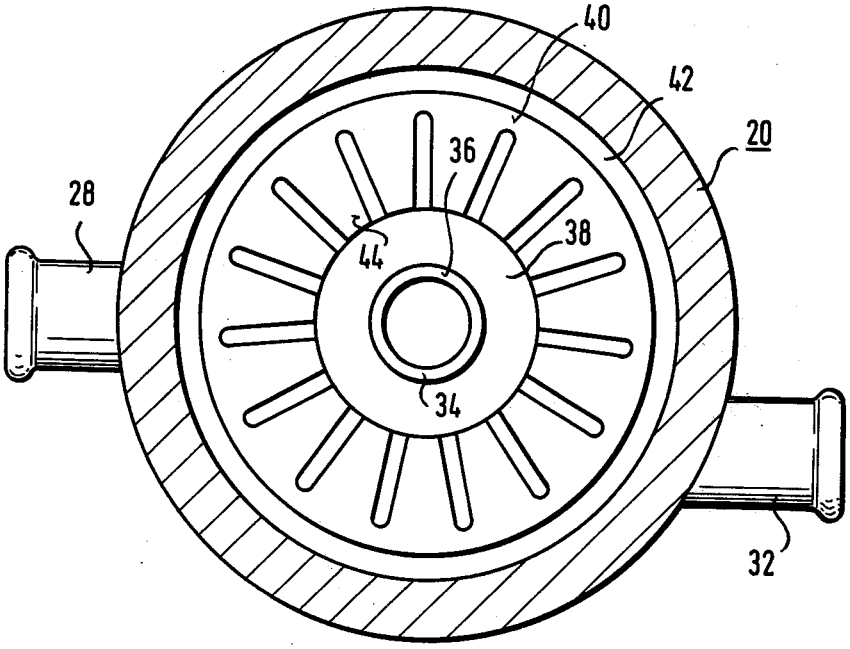

There are shown in:

FIG. 1 a section through the crankcase ventilation valve according to the invention;

FIG. 2 a section through FIG. 1 on the line II—II, in which the support surface according to the invention is provided with radially extending support ribs which are arranged at a spacing and which extend from the annular space.

The drawing illustrates a diaphragm non-return valve 10 which forms a constructional unit with the separator 12. The diaphragm valve 10 comprises a valve body 14 and a valve cover 16 which may be screwed to the valve body 14 or is screwed thereon. A diaphragm 18 is securely clamped between the valve body 14 and the valve cover 16 and divides the valve casing 20 into a first chamber 22 which is limited by the valve cover 16 and the diaphragm 18, and a second chamber 24 which is limited by the valve body 14 and the diaphragm 18. The valve cover 16 is provided with openings 26 through which the first chamber 22 is connected to the atmosphere. The valve body 14 has attached thereto an inlet tube 28 with a pressure limiting valve 30 of usual construction and an outlet tube 32, by screwing in or pressing in. Furthermore, the valve body 14 has arranged thereon a tubular member 34 as a hollow-cylindrical valve seat body which comprises a circular ring-shaped valve seat surface 36. This tubular member 34 may be constructed in one piece with the valve body 14, or it may be screwed or pressed into the same. The tubular member 34 is surrounded by an upwardly open concentric ring space 38 in which terminates the inlet tube 28. When the valve is closed, the diaphragm 18 lies on the valve seat surface 36 and on the support surface 40. The diaphragm 18 may consist of e.g. synthetic resin or synthetic rubber. The support surface 40 extends to the edge of the valve casing 20 and comprises at its periphery an annular groove 42 and radially extending support ribs 44 which are arranged at a spacing and which extend from the ring space 38. For providing tension in the diaphragm 18, a teflon ring is disposed in the annular groove 42. The surface ratio between the surface of the diaphragm 18 loaded by the pressure of the suction device and that loaded by the pressure of the crankcase amounts to at least 1:10, preferably however from 1:25 to 1:30. Thereby the influence of the pressure of the suction device on the crankcase ventilation gas stream is considerably reduced with the consequence that the pressure in the crankcase is relatively independent of the underpressure of the suction device.

The separator 12 is disposed below the diaphragm non-return valve 10 and comprises a casing 46 which is fixed to the valve body 14 and which is provided with cooling ribs 48. An insert 50 with cooling plates 52 is located in the interior of the casing 46. This insert 50 is connected to the outlet opening of the tubular member 34 and the medium leaving the valve 10 flows therethrough.

The downwardly open casing 46 is closed by a container 54 which is filled with a filler material 56, e.g. cellulose, which possesses a highly absorbent property. The container 54 is releasably fixed to the casing 46 by means of closures 58. A sealing ring 60 is arranged between the casing 46 and the container 54, in order to close the inner space 62 of the casing 46 tightly againt the outside. This inner space 62 is in communication with the outlet tube 32 by way of a passage opening 64 in the valve casing 20. This outlet tube 32 is connected by means of a connecting tube or pipe (not illustrated in detail) to the air filter 66 (illustrated merely diagrammatically) of an internal combustion engine. Likewise illustrated merely diagrammatically is the carburettor 68 of known construction connected beyond the air filter 66.

The inlet tube 28 is in communication with the interior of the crankcase of the internal combustion engine by way of a flexible tube or a pipe line, not illustrated. The inlet tube 28 is advantageously connected to the rocker lever casing or to the tappet casing of the internal combustion engine. It is known that these casings are connected to the crankcase by the tappet guides and further compensating ducts. However, it may also be envisaged that the inlet tubes 28 are connected directly to the crankcase.

When then, as mentioned before, an overpressure is produced in the crankcase or in the rocker lever and tappet casing connected thereto owing to the movement of the pistons and other engine parts, the diaphragm 18 is lifted off the valve seat surface 36 by this overpressure. Thus a connection is produced between the interior of the crankcase and the suction device. Thereby gas laden with harmful substances can travel from the crankcase through the inlet tube 28, the concentric ring space 38 and the tubular member 34 into the separator 12. Upon flowing through the cooling plates 52 the gas or vapour-like harmful substances condense. The condensate is absorbed by the filler material 56 in the container 54. This container 54 or the filler material 56 thereof may be interchanged periodically. Since the harmful substances contained in the gas are largely separated out in the separator 12 in the described manner, the gas issuing through the outlet tube 32 is practically free of harmful substances and may then be fed without disadvantageous consequences to the carburettor 68 for after-burning.

When then during the upward movement of the pistons, an underpressure relatively to the surroundings is produced in the crankcase, the valve 10 closes by the diaphragm 18 resting the valve seat surface 36. Thus no gas can flow back from the suction device into the crankcase. The consequence of the underpressure is that issue of lubricant through sealing faces and seals (Simmer rings, sleeves, etc.) and entry of lubricant into the combustion spaces is avoided. Since gas laden with dirt and dust particles from the ambient air cannot enter in the crankcase, pollution of the lubricant and wear effects caused by these dirt and dust particles are avoided. Also corrosive condensates cannot be formed which may be produced by compounding saponifyable components of lubricating oil and water vapour contained in the ambient air. The reduced boiling point caused by the underpressure, of the water prevents condensation of the entering water vapour (air humidity). The water vapour is ejected at once again through the valve, whereby no oil-water emulsions are produced.

At underpressure, the moving engine parts operate with less resistance, the consequence of which is a higher degree of thermal efficiency. Furthermore, owing to the underpressure the lubrication of the piston rod bearings and the main bearings is favourably affected even when the engine is switched off.

The crankcase ventilation valve illustrated in the drawing is fixed in the space of the internal combustion engine in such a manner that the cooling air conveyed by the cooling fan flows around the casing 46.

In order to ensure optimum operation, the crankcase ventilation valve must be attached higher than the highest point of the rocker lever casing, in order that entry of lubricating oil into the valve is prevented. Instead of as a constructional unit, the separator 12 and the valve 10 may alternatively be constructed as two separate constructional units.

The direct influence of the suction pressure on the crankcase ventilating gas stream is reduced by the crankcase ventilation valve described. It is rendered possible thereby on the one hand to maintain the desired crankcase pressure and to dimension reliably the outflow of crankcase vapours to the suction device, in order to prevent soiling of the suction device on the one hand and to maintain the desired mixture composition on the other hand. The crankcase ventilation valve according to the invention responds rapidly and possesses a simple construction. It may be used for all kinds of internal combustion engines of the Otto engine type with any desired number of cylinders.

I claim:

1. Crankcase ventilation valve for internal combustion engines with a valve casing which is divided into a first and a second chamber by a displaceable wall sealingly attached at the periphery, wherein the first chamber is in communication with the atmosphere and the second chamber is in communication on the one hand through an inlet tube with the crankcase and on the other hand through an outlet tube with the suction device by way of a cylindrical tubular member disposed in the second chamber, the displaceable wall and the tubular member being constructed as a non-return valve and the valve seat being surrounded by a concentric ring space which is connected to the inlet tube, wherein the displaceable wall is constructed as a diaphragm of a very light, elastic material; a support surface for the diaphragm is arranged around the tubular member forming the valve seat face, above the concentric ring space, the diaphragm extending to the edge of the valve casing; the support surface comprises an annular groove at the outer edge and radially extending support ribs which are arranged at a spacing and which extend from the concentric ring space, and wherein the diaphragm is arranged in the annular groove for providing tension and in its closing position rests on the support ribs and the ratio of the surface of the diaphragm loaded by the pressure of the suction device to that loaded by the pressure of the crankcase amounts to at least 1:10.

2. Crankcase ventilation valve according to claim 1, wherein the said ratio is from 1:25 to 1:30.

3. Crankcase ventilation valve according to claim 1, wherein a pressure limiting valve is arranged in the inlet tube.

4. Crankcase ventilation valve according to claim 1, wherein the support surface is constructed as a filter-like support element.

5. Crankcase ventilation valve according to claim 1, wherein a teflon ring is disposed above the diaphragm in the annular groove.

6. Crankcase ventilation valve according to claim 1, wherein the opening path of the diaphragm is limited by an abutment which is formed preferably by the valve cover.

7. Crankcase ventilation valve according to claim 1, wherein a separator is disposed in the second chamber downstream of the non-return valve.

8. Crankcase ventilation valve according to claim 1, wherein the separator, comprises a removable container which is provided with absorbent filler material for retaining the harmful substances separated out.

9. Crankcase ventilation valve according to claim 1, wherein the separator comprises cooling plates through which the gases flow which issue from the non-return valve.

10. Crankcase ventilation valve according to claim 1, wherein the non-return valve and the separator form a constructional unit.

11. Crankcase ventilation valve according to claim 1, wherein the non-return valve is so arranged that it is located higher than the highest point of the rocker lever casing of the internal combustion engine.

* * * * *